US006299072B1

(12) United States Patent
Burns

(10) Patent No.: US 6,299,072 B1
(45) Date of Patent: Oct. 9, 2001

(54) TOY TRAIN TRACK CONNECTOR

(75) Inventor: David Thomas Burns, Lake Forest, IL (US)

(73) Assignee: Learning Curve Toys International, Inc., Chicago, IL (US)

( * ) Notice: Subject to any disclaimer, the term of this patent is extended or adjusted under 35 U.S.C. 154(b) by 0 days.

(21) Appl. No.: 09/473,151

(22) Filed: Dec. 28, 1999

Related U.S. Application Data

(60) Provisional application No. 60/119,671, filed on Feb. 11, 1999.

(51) Int. Cl.[7] ..... E01B 23/00

(52) U.S. Cl. ..... 238/10 F; 238/10 E; 104/53

(58) Field of Search ..... 238/10 E, 10 F, 238/10 R, 10 A, 10 B, 10 C; 104/53, 60, DIG. 1

(56) References Cited

U.S. PATENT DOCUMENTS

| | | | | |
|---|---|---|---|---|
| D. 248,887 | | 8/1978 | Tanaka . | |
| D. 249,737 | | 9/1978 | Tong . | |
| D. 260,105 | | 8/1981 | Matsumoto . | |
| D. 265,751 | | 8/1982 | Udagawa . | |
| D. 266,529 | | 10/1982 | Aoki . | |
| D. 270,261 | | 8/1983 | Lee . | |
| D. 330,231 | | 10/1992 | Tachikawa . | |
| D. 330,232 | | 10/1992 | Tachikawa . | |
| 3,581,988 | | 6/1971 | Kin et al. . | |
| 3,589,064 | | 6/1971 | Harada . | |
| 3,590,522 | | 7/1971 | Hamano . | |
| 3,592,384 | | 7/1971 | Tomaro . | |
| 3,603,505 | | 9/1971 | Tsugawa . | |
| 3,633,309 | | 1/1972 | Yoshie . | |
| 3,645,445 | | 2/1972 | Lai et al. . | |
| 3,645,448 | | 2/1972 | Houser . | |
| 3,650,468 | | 3/1972 | Ewe et al. . | |
| 3,680,777 | | 8/1972 | Arai . | |
| 3,703,989 | | 11/1972 | Tomiyama . | |
| 4,066,211 | * | 1/1978 | Mak | 238/10 F |
| 4,081,133 | * | 3/1978 | Tong | 238/10 F |
| 4,082,220 | | 4/1978 | Cheng et al. . | |
| 4,106,695 | * | 8/1978 | Carella et al. | 238/10 F |
| 4,150,789 | * | 4/1979 | Tong | 238/10 E |
| 4,179,066 | | 12/1979 | Teter . | |
| 4,203,548 | * | 5/1980 | Cheng | 238/10 F |
| 4,219,153 | * | 8/1980 | Cheng | 238/10 E |
| 4,221,076 | | 9/1980 | Ozawa . | |
| 4,225,081 | * | 9/1980 | Ikegame | 238/10 E |
| 4,260,104 | | 4/1981 | Schaffan . | |
| 4,373,293 | | 2/1983 | Kakizaki et al. . | |
| 4,496,100 | | 1/1985 | Schwager et al. . | |
| 4,521,206 | | 6/1985 | Saffer et al. . | |
| 4,544,094 | | 10/1985 | Scholey . | |
| 4,558,867 | | 12/1985 | Hippely . | |
| 4,652,248 | | 3/1987 | Kozuka . | |
| 4,771,943 | | 9/1988 | Cooney et al. . | |
| 4,898,326 | * | 2/1990 | Edwards et al. | 238/10 E |
| 4,919,052 | | 4/1990 | Yoneda et al. . | |

(List continued on next page.)

*Primary Examiner*—S. Joseph Morano
*Assistant Examiner*—Lars A. Olson
(74) *Attorney, Agent, or Firm*—Wallenstein & Wagner, Ltd

(57) ABSTRACT

A toy track segment including a connector assembly for adjoining the toy track segment to a second toy track segment. The connector assembly comprises a male guide pin, a female guide pin receptor, a male connector latch, a female connector receptor, and a release mechanism. The male guide pin is adapted for insertion into the female guide pin receptor slot. The male connector latch is adapted for insertion into the female connector receptor. The male connector latch includes a keeper for locking the male connector within the female connector receptor. The release mechanism provides relative movement between the male connector latch of the first toy track segment and the female connector receptor of the second toy track segment. The release mechanism allows the adjoining track segments to be easily connected and disconnected.

9 Claims, 3 Drawing Sheets

U.S. PATENT DOCUMENTS

| | | | | |
|---|---|---|---|---|
| 4,997,187 | * | 3/1991 | Smollar et al. | 238/10 E |
| 5,038,685 | | 8/1991 | Yoneda et al. . | |
| 5,075,515 | | 12/1991 | Yoneda et al. . | |
| 5,403,004 | | 4/1995 | Kennedy . | |
| 5,405,080 | * | 4/1995 | Yeung et al. | 238/10 F |
| 5,441,435 | | 8/1995 | Shiraishi . | |
| 5,503,330 | * | 4/1996 | Riley | 238/10 E |
| 5,529,241 | | 6/1996 | Roder . | |
| 6,019,289 | * | 2/2000 | Sung | 238/10 E |

* cited by examiner

TOY TRAIN TRACK CONNECTOR

RELATED APPLICATION

This Application claims the benefit of Provisional Patent Application Ser. No. 60/119,671, filed Feb. 11, 1999.

TECHNICAL FIELD

The present invention relates generally to toy vehicle track and, more particularly, to a toy train track connector device for joining lengths of toy train track end to end.

BACKGROUND

In the toy vehicle industry, small toy trains are often run on plastic or wood tracks. These railway systems are designed to grow with the child. In other words, railway configurations can range from very simple ovals to complex systems incorporating bridges, buildings, tunnels, and towns. Many other accessories are available as well, such as toy figurines, bushes, shrubs, and trees to lend the system a realistic effect; playmats, playboards, and play tables on which to build a railway system; carry bags and boxes in which to store the railway system when not in use; and, storybooks, iron-ons, decals, and coloring books to further stimulate the child's imagination.

The railway configurations are built from individual track sections. The track sections range in size and shape. There are countless possibilities for individual track sections: some are straight; some feature switching mechanisms; some are curved; and some are ascending for connection to another track positioned at a higher level.

One of the most important aspects of these railway systems is that the track sections be interchangeable. Accordingly, most track sections include male and/or female connectors at opposing ends. This allows the track sections to be connected end to end in a variety of configurations. The connectors also provide the means by which the track segments are aligned with each other.

It is known in the prior art to provide toy train segments which are capable of being joined together by way of male pins extending longitudinally from the end of one track segment mating with corresponding female recesses in the end of an adjoining track segment. For example, U.S. Pat. No. 5,503,330 describes such a track segment.

One problem associated with these types of track segments is that they are difficult to disconnect from each other. To disconnect the track segments, the user must grasp both segments and pull or twist them apart. This creates stress on the fragile projections which could cause them to snap off.

In addition, when disconnecting a segment which is adjoined to two or more other segments, a large amount of stress is placed on the connection between the segment being disconnected and the segment which is not being disconnected. For instance, if track segment A is attached at one end to track segment B and at an opposing end to track segment C. The connection between track segment A and track segment C will undergo a bending stress when segment A and segment B are being disconnected. This is caused by lifting segments A and B to pull them apart while leaving segment C dangling from segment A.

Other problems exist with track connectors. For example, many times the connections between adjoined segments is unreliable, and the segments will become disconnected while vehicles are traversing the track. Also, some track segments have sharp parts that can cause injury. Finally, some track segment connectors do not allow the necessary interchangeability because they can only be oriented in one direction to make a connection with an adjoining segment.

This invention was designed to overcome problems associated with prior art track connectors.

SUMMARY OF THE INVENTION

The following invention relates to connection assemblies for joining toy vehicle track segments together. The connection assembly of the present invention comprises a male guide pin, a male connector latch, a female connector receptor, and a female guide pin receptor.

The male guide pin extends outwardly from an end wall of the track segment. The male guide pin is adapted for insertion into the female guide pin receptor which extends inwardly from the end wall. Each male guide pin has a linear wall joined at an arcuate apex to a tapered wall. The guide pin further includes grooved upper and lower surfaces.

The female guide pin receptor includes a housing for receiving the male guide pin. The housing includes a continuous inner wall. The inner wall comprises a linear portion for mating with the linear wall of the male guide pin, a curved portion for mating with the apex of the male guide pin, and an angled portion for mating with the tapered wall of the male guide pin. The housing further comprises opposing upper and lower ribbed walls. The upper and lower ribbed walls are adapted for mating with the grooved upper and lower surfaces of the male guide pin.

The male connector latch of a track segment and the female connector receptor of an adjoining track segment cooperate to fix pairs of track segments together. Accordingly, the male connector latch extends outwardly from the end wall of the track segment. The female connector receptor extends inwardly from the end wall of the track segment for receiving the male connector of an adjoining track segment. Each male connector latch includes an upwardly projecting keeper for mating with a corresponding downwardly projecting keeper within the female connector receptor.

The male connector latch/female connector receptor combination includes a push button release mechanism. The push button release mechanism provides relative movement between the male connector latch of one track segment and the female connector receptor of an adjoining track segment. The push button release mechanism comprises a push button located on the upper surface of the track segment. The push button is interconnected to a flexible tongue so that when a downward force is applied to the push button the tongue will flex downwardly. A beam on the underside of the tongue acts to disengage the upwardly projecting keeper of the male connector latch from the corresponding downwardly projecting keeper of the female connector receptor when the downward force is applied to the push button.

Other advantages and aspects of the present invention will become apparent upon reading the following description of the drawings and detailed description of the invention.

DETAILED DESCRIPTION

Figure 1:
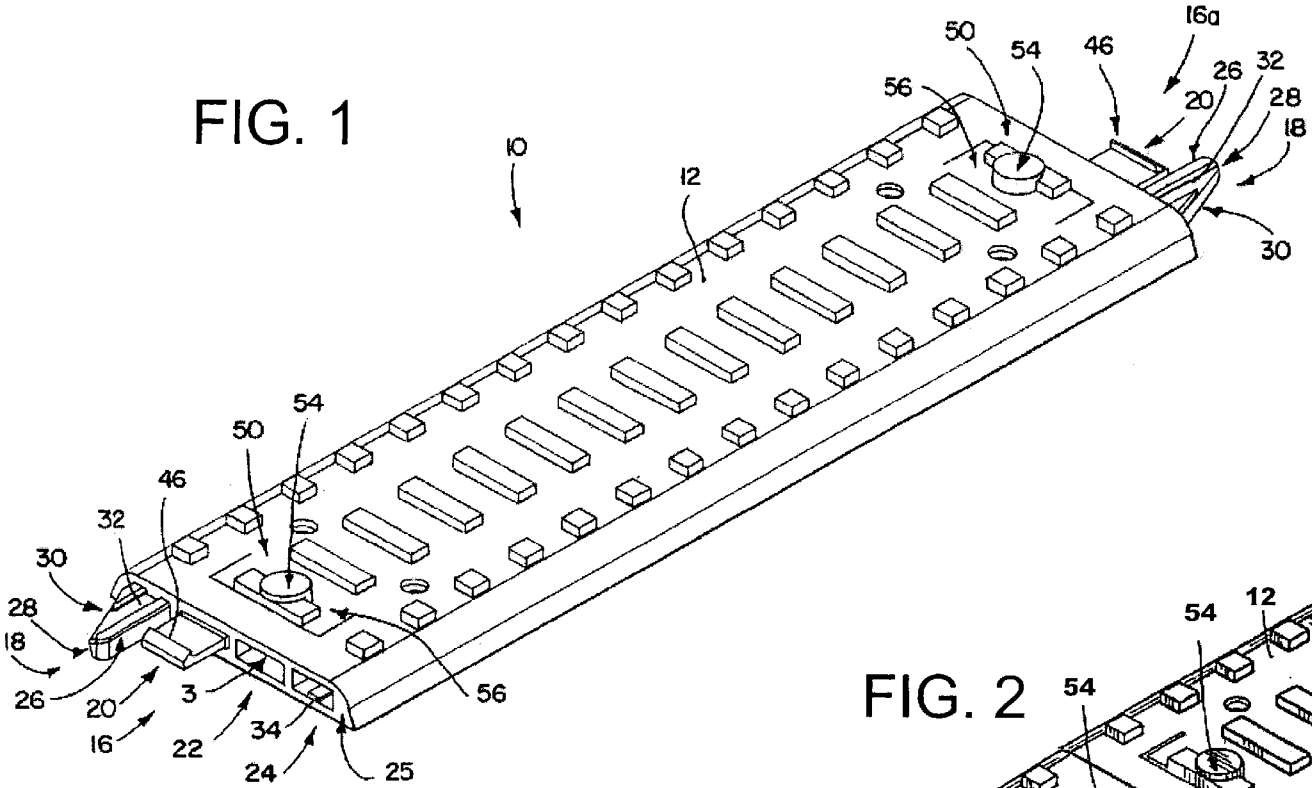
FIG. 1 is a perspective view of a track segment of the present invention.
Figure 2:
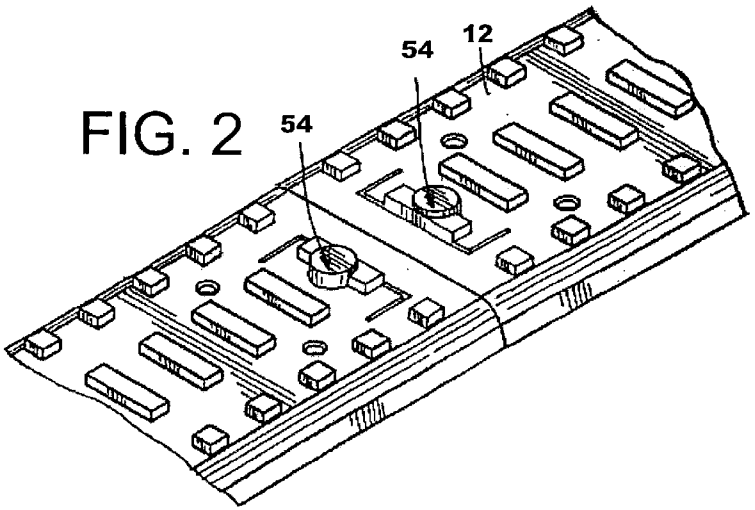
FIG. 2 is a perspective view of a pair of coupled track segments.
Figure 3:
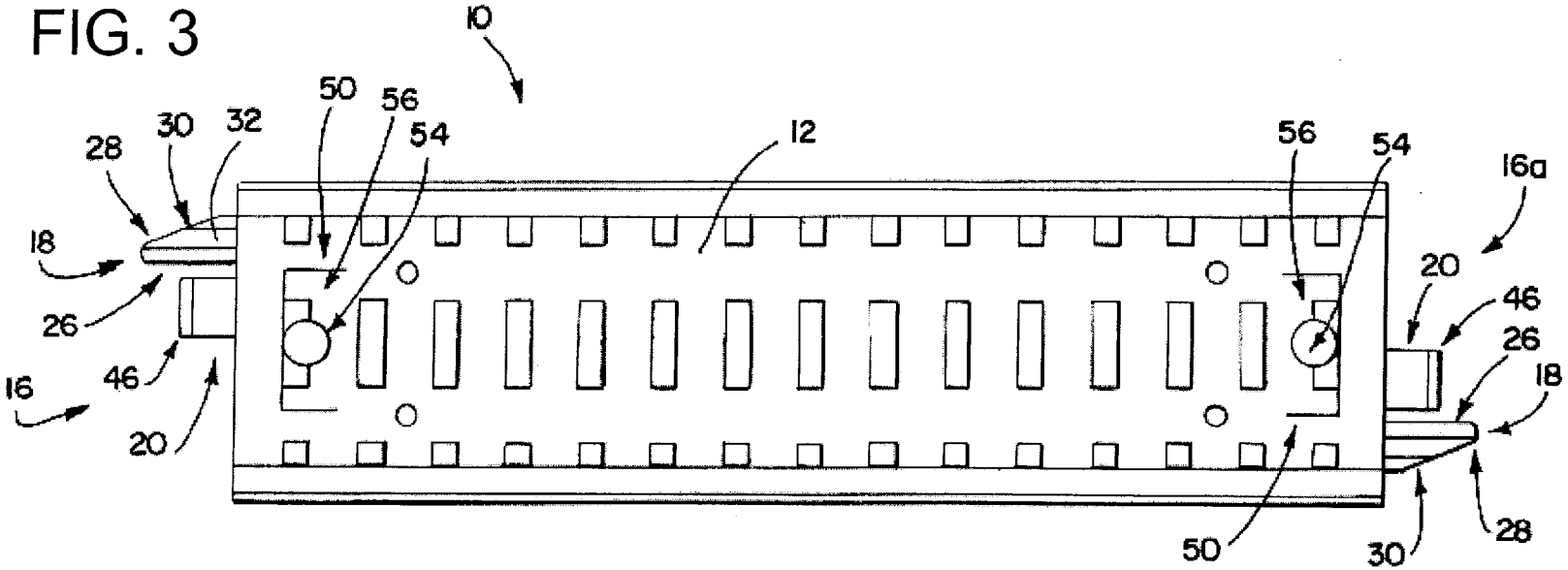
FIG. 3 is a top view of a track segment of the present invention.
Figure 4:
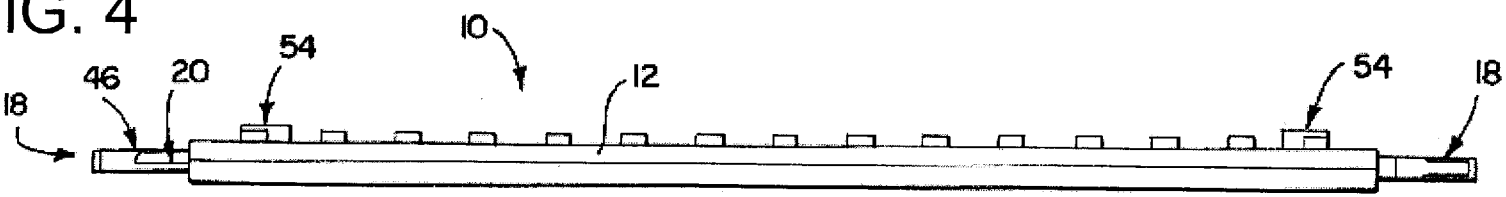
FIG. 4 is a side view of a track segment present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 is a perspective view of a toy train track segment 10 of the present invention. The track segment 10 is generally produced from a plastic material, but can be produced from any suitable material such as a metal or wood. Track segments 10 of the present invention include an upper surface 12 over which a toy train can travel. The train track segment 10 further includes identical first and second connection assemblies 16, 16*a* on opposing ends. The identical connection assemblies 16, 16*a* allow multiple track segments 10 to be interchangeable which leads to flexibility in constructing toy railway systems. Each connection assembly 16, 16*a* comprises a male guide pin 18, a male connector latch 20, a female connector receptor 22, and a female guide pin receptor 24.

Figure 5:
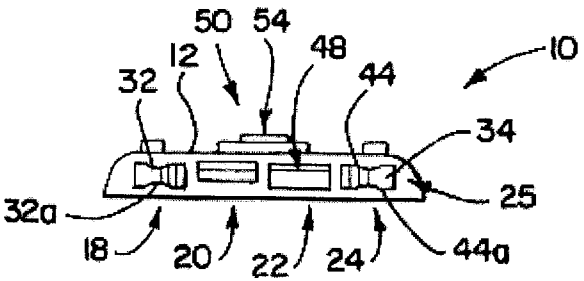
FIG. 5 is an end view of a track segment of the present invention.
Figure 6:
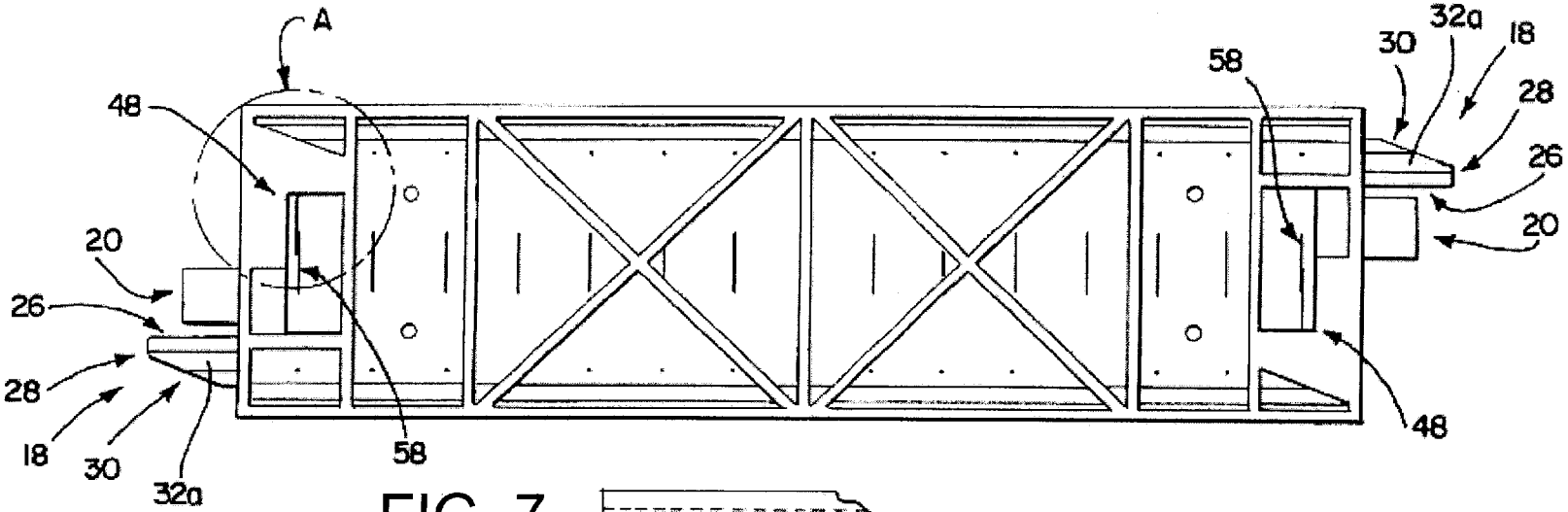
FIG. 6 is a bottom view of a track segment of the present invention.

The male guide pin 18 extends outwardly from an end wall 25 of the track segment 10. The male guide pin 18 of each track segment 10 is adapted for insertion into the female guide pin receptor 24 which extends inwardly from the end wall 25. The male guide pin 18 and the female guide pin receptor 24 cooperate to align connected pairs of track segments 10 and prevent lateral shifting of the track segments 10 relative to each other. Accordingly, each male guide pin 18 has a linear wall 26 joined at an arcuate apex 28 to a tapered wall 30. The guide pin 18 further includes grooved upper and lower surfaces 32, 32*a*. (See FIG. 5). The smooth, arcuate shape of the apex 28 facilitates the guide pin's 18 insertion into and alignment with the female guide pin receptor 24.

Figure 7:
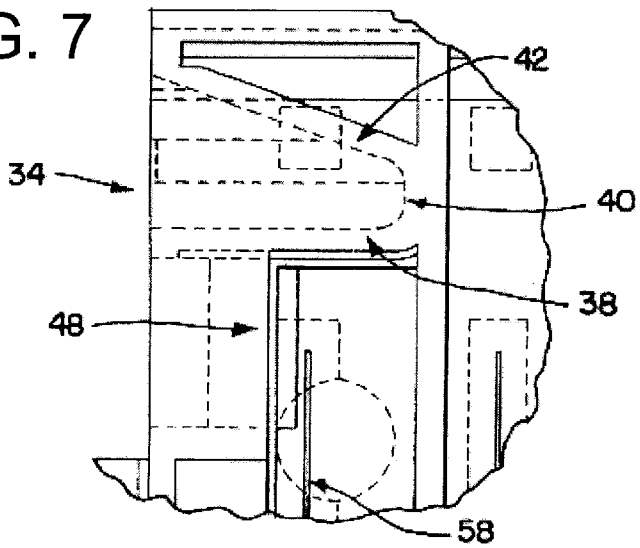
FIG. 7 is a cross-sectional view of a portion of FIG. 6.

Referring to FIG. 7, the female guide pin receptor 24 includes a housing 34 for receiving the male guide pin 18. The housing 34 includes a continuous inner wall. The inner wall comprises a linear portion 38 for mating with the linear wall 26 of the male guide pin 18, a curved portion 40 for mating with the apex 28 of the male guide pin 18, and an angled portion 42 for mating with the tapered wall 30 of the male guide pin 18. The housing 34 further comprises opposing upper and lower ribbed walls 44, 44*a*. (See FIG. 5). The upper and lower ribbed walls 44, 44*a* are adapted for mating with the grooved upper and lower surfaces 32, 32*a* of the male guide pin 18.

Referring again to FIG. 1, the male connector latch 20 of a track segment 10 and the female connector receptor 22 of an adjoining track segment 10 cooperate to fix pairs of track segments 10 together. Accordingly, the male connector latch 20 extends outwardly from the end wall 25 of the track segment 10. The female connector receptor 22 extends inwardly from the end wall 25 of the track segment 10 for receiving the male connector 20 of an adjoining track segment 10. Each male connector latch 20 includes an upwardly projecting keeper 46 for mating with a corresponding downwardly projecting keeper 48 (shown in FIG. 5) within the female connector receptor 22.

The male connector latch 20/female connector receptor 22 combination includes a push button release mechanism 50. The push button release mechanism 50 provides relative movement between the male connector latch 20 of one track segment 10 and the female connector receptor 22 of an adjoining track segment 10 so that the adjoined pair of track segments 10 can be easily connected and disconnected along a horizontal plane; i.e., no bending or twisting of adjoining the track segments 10 is necessary. The push button release mechanism 50 comprises a push button 54 located on the upper surface 12 of the track segment 10. The push button 54 is interconnected to a flexible tongue 56. Thus, when a downward force is applied to the push button 54, the tongue 56 will flex downwardly. A beam 58 on the underside of the tongue 56 acts to disengage the upwardly projecting keeper 46 of the male connector latch 20 from the corresponding downwardly projecting keeper 48 of the female connector receptor 22 when the downward force is applied to the push button 54.

While a specific embodiment has been illustrated and described, numerous modifications are possible without departing from the spirit of the invention, and the scope of protection is only limited by the scope of the accompanying claim.

What is claimed is:

1. A first toy track segment including a connector assembly for joining the first toy track segment to the connector assembly of a second toy track segment, the connector assembly comprising:

a male guide pin extending outwardly from an end wall of the first track segment, the male guide pin comprising a grooved upper surface and a grooved lower surface;

a female guide pin receptor comprising an upper ribbed wall and a lower ribbed wall adapted for mating with the grooved upper and lower surfaces of the male guide pin;

a male connector latch extending outwardly from the end wall of the first track segment; and a female connector receptor adapted for receiving the male connector latch wherein a portion of the male connector latch engages a portion of the female connector receptor to lock the male connector latch within the female connector receptor.

2. The connector assembly of claim 1 wherein the male guide pin includes a straight segment connected at an arcuate apex to a tapered wall.

3. The connector assembly of claim 1 further comprising a release mechanism for providing relative movement between the male connector latch of the first toy track segment and the female connector receptor of the second toy track segment wherein the first and second track segments can be connected and disconnected.

4. The connector assembly of claim 2 wherein the release mechanism includes a push button located on an upper surface of the first track segment and attached to a flexible tongue having a beam located on an underside for engaging a portion of the keeper wherein activating the release mechanism disengages the portion of the male connector latch from the portion of the female connector receptor and allows the first track segment and the second track segment to be disconnected.

5. A toy track segment having a track connector on each end for connecting the toy track segment to an adjacent track segment, the track connector comprising:

a male guide pin extending outwardly from an end wall of the track segment, the male guide pin comprising a straight segment connected at an arcuate apex to a tapered wall;

a female guide pin receptor slot extending inwardly from the end wall of the track segment and adapted for receiving the male guide pin from the adjacent track segment, the female guide pin receptor slot defining a housing comprising a linear portion, a curved portion, and an angled portion for mating with the straight segment, the arcuate apex and the tapered wall of the make guide pin, respectively;

a male connector latch extending outwardly from the end wall of the track segment and having a keeper located at a proximal end; and a female connector receptor extending inwardly from the end wall of the track segment and adapted for receiving the male connector latch of the adjacent track segment wherein a portion of the female connector receptor engages the keeper for locking the male connector of the adjacent track segment within the female connector receptor.

6. The track connector of claim 5 further comprising a release mechanism for providing relative movement between the male connector latch of the toy track segment and the female connector receptor of the adjacent toy track segment wherein the track segments can be connected and disconnected.

7. The connector assembly of claim 6 wherein the male guide pin includes a grooved upper surface and a grooved lower surface adapted for mating with upper and lower ribbed walls within the female guide pin receptor slot.

8. The connector assembly of claim 6 wherein the release mechanism includes a push button located on an upper surface of the first track segment and attached to a flexible tongue having a beam located on an underside for engaging a portion of the keeper wherein activating the release mechanism disengages the keeper from the female connector receptor and allows the track segment and the adjacent track segments to be disconnected.

9. A toy track segment having a track connector on each end for connecting the toy track segment to an adjacent track segment, the track connector comprising:

a male guide pin extending outwardly from an end wall of the track segment and having a linear wall joined at an arcuate apex to a tapered wall, a grooved upper surface, and a grooved lower surface;

a female guide pin receptor slot defining a housing having a ribbed upper surface and a ribbed lower surface and extending inwardly from the end wall of the track segment, the female guide pin receptor slot further comprising an angled wall for engaging the first tapered wall of the male guide pin wherein the housing is adapted for receiving the male guide pin from the adjacent track segment;

a male connector latch extending outwardly from the track segment end wall and including an upwardly extending keeper;

a female connector receptor extending inwardly from the end wall of the track segment, having a downwardly extending keeper and adapted for receiving the male connector latch of the adjacent track segment wherein the downwardly extending keeper of the female connector receptor engages the upwardly extending keeper of the male connector latch to lock the male connector latch of the adjacent track segment within the female connector receptor; and a release mechanism for providing relative transverse movement between the male connector latch of the track segment and the female connector receptor of the adjacent track segment, the release mechanism including a push button located on an upper surface of the track segment and attached to a flexible tongue having a beam located on an underside for engaging a portion of the upwardly extending keeper of the male connector latch wherein activating the release mechanism disengages the upwardly extending keeper from the downwardly extending keeper of the female connector receptor.

* * * * *

UNITED STATES PATENT AND TRADEMARK OFFICE

CERTIFICATE OF CORRECTION

PATENT NO. : 6,299,072 B1
DATED : October 9, 2001
INVENTOR(S) : Burns

It is certified that error appears in the above-identified patent and that said Letters Patent is hereby corrected as shown below:

Column 1,
Line 57, insert -- , -- after "segment C" and delete "."

Column 2,
Line 65, insert -- of the -- after "segment"

Column 4,
Line 6, insert -- the -- after "twisting of"
Line 7, delete "the" before "track segments 10"

Signed and Sealed this

Fourth Day of February, 2003

JAMES E. ROGAN
*Director of the United States Patent and Trademark Office*